US005800742A

United States Patent [19]

Cheng

[11] Patent Number: 5,800,742

[45] Date of Patent: Sep. 1, 1998

[54] UNDERWATER AIR DELIVERING DEVICE

[76] Inventor: Mao-Chung Cheng, No. 274, Chung-Shan Rd., Hsin-Chu City, Taiwan

[21] Appl. No.: 774,598

[22] Filed: Dec. 30, 1996

[51] Int. Cl.[6] ..... B01F 3/04

[52] U.S. Cl. ..... 261/87

[58] Field of Search ..... 261/87

[56] References Cited

U.S. PATENT DOCUMENTS

| | | | |
|---|---|---|---|
| 1,925,777 | 9/1933 | Sperling | 261/87 |
| 3,108,146 | 10/1963 | Gross | 261/87 |
| 4,283,357 | 8/1981 | Sidery | 261/87 |
| 4,720,361 | 1/1988 | Andersson | 261/87 |
| 4,925,598 | 5/1990 | Kiristo et al. | 261/87 |
| 4,990,166 | 2/1991 | Babich | 261/87 |
| 5,389,310 | 2/1995 | Leiponen | 261/87 |

FOREIGN PATENT DOCUMENTS

| | | | |
|---|---|---|---|
| 688308 | 3/1953 | United Kingdom | 261/87 |

*Primary Examiner*—Tim R. Miles

*Attorney, Agent, or Firm*—Browdy and Neimark

[57] ABSTRACT

An improved air delivering device for use in a fish raising pond is provided with a hollow shaft having a plurality of slantly drilled holes disposed thereon and connected to the output shaft of a motor. The motor is disposed on the roof of a shelter casing in which the output shaft in connection to the hollow shaft is housed. To the end of the hollow shaft is secured a sleeve having a plurality of discharge bores communicating with the hollow shaft and a blade assembly is integrally formed with the sleeve. An extensible air introducing duct in connection to the shelter casing permits air to be led into the shelter casing for mixing with water in the hollow shaft and discharged through the multiple bores into the underwater area so as to increase the oxygen content level therein.

4 Claims, 3 Drawing Sheets

UNDERWATER AIR DELIVERING DEVICE

BACKGROUND OF THE INVENTION

The present invention relates to an improved underwater air delivering device for use in a marine farm or fish raising pond. The air delivering device is designed to transmit air to underwater area in a fish raising pond so as to increase the oxygen content in the deep water of a pond.

Marine farms or fish raising ponds are popularly established in third world countries for massive harvest of marine products. It is a common problem that the fish are farmed in such a high density that underwater oxygen content is generally low. So, it is necessary to deliver air to the underwater of such ponds continually so as to increase the underwater oxygen content level. The most common way is to employ blade-type water stirring device which can only improve the oxygen content level at the superficial area of a pond not the underwater area.

SUMMARY OF THE INVENTION

The primary object of the present invention is to provide a simply structured air delivering device for use in a fish raising pond to effect the air pumping purpose under the water for increasing the underwater oxygen content and to mainly reduce the cost of production of such an air delivering device.

DETAILED DESCRIPTION OF THE PREFERRED EMBODIMENTS

Figures 1, 1A:
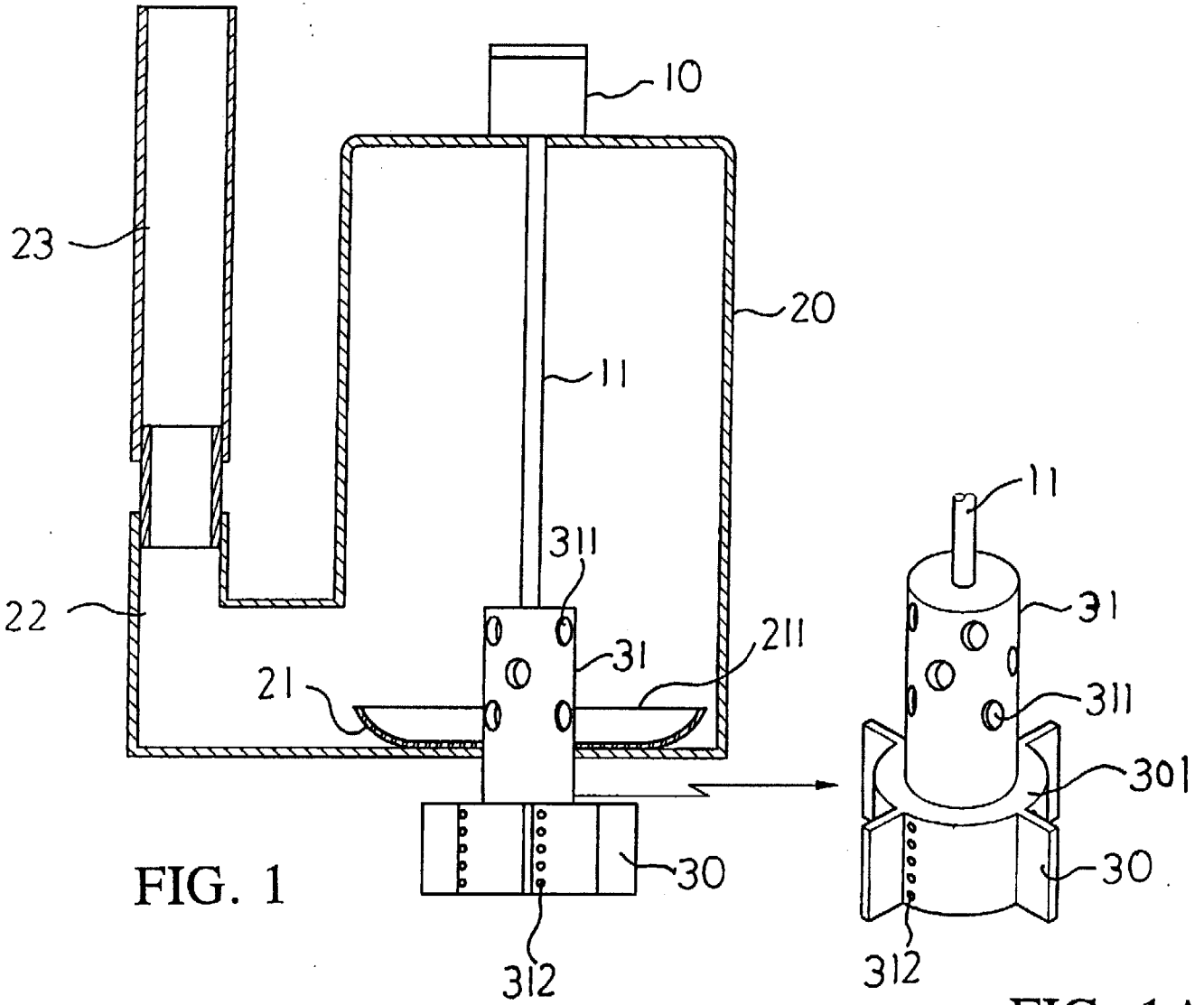
FIG. 1 is a sectional view of the present invention.
FIG. 1A is an enlarged diagram of the blade assembly.
Figure 2:
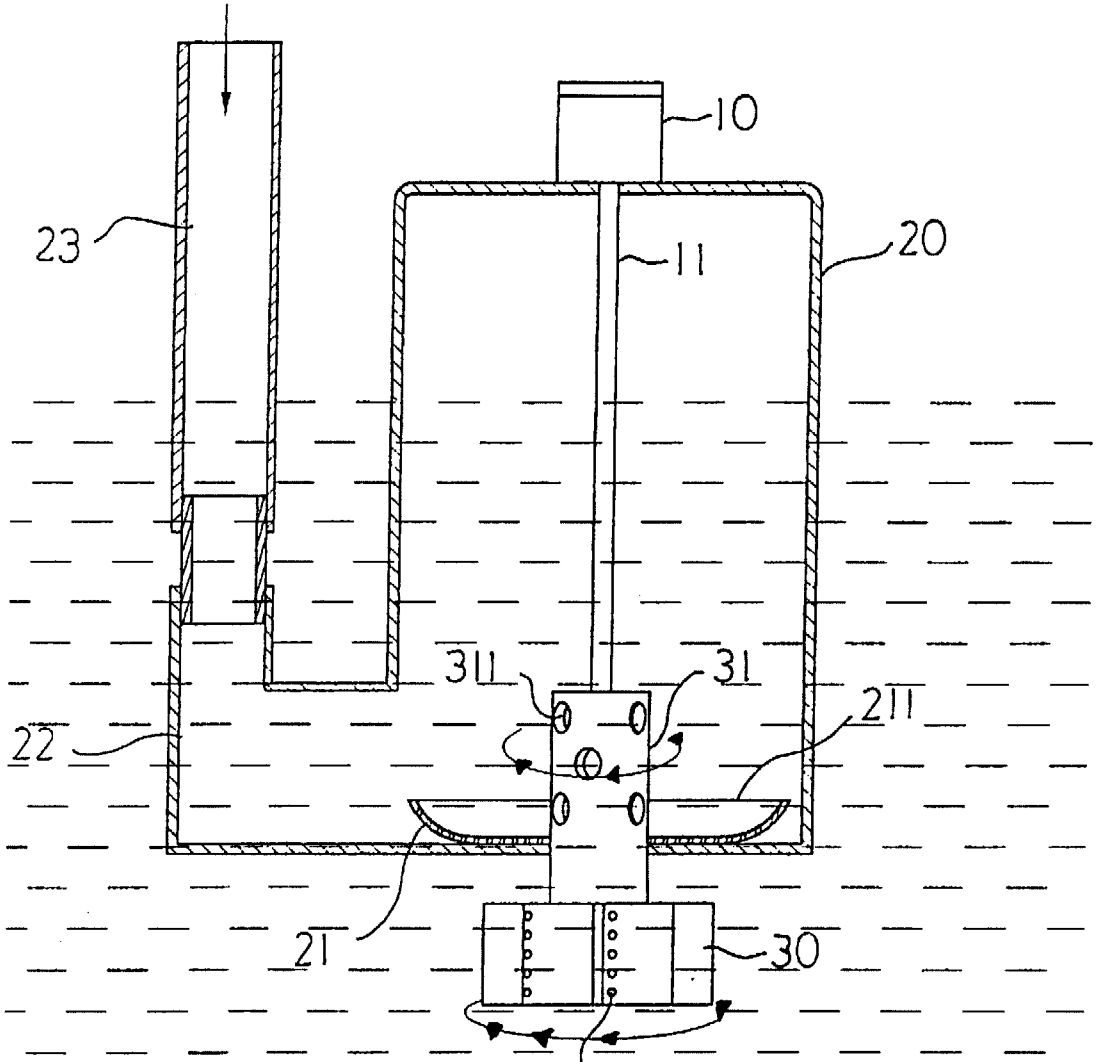
FIG. 2 is a sectional view of the present invention in an operation mode.

Referring to FIGS. 1, 2, the air delivering device of the present invention is comprised of a motor 10, a shelter casing 20, an extensible air introducing duct 23, a blade assembly 30. The motor 10 is disposed on the roof of the shelter casing 20 and its output shaft 11 connects to the blade assembly 30. Fresh air is led into the interior of the shelter casing 20 via the extensible air introducing duct 23 so as to mingle the air with the water therein by way of the rotating blade assembly for increasing the oxygen content level of the underwater area. The above operation is the same as a common prior art air delivering device. However, the present invention is characterized in the partition tray 21 and slantly drilled holes 311 and discharge pores 312 adjacent to each blade 30.

The shelter casing 20 is of a cylindrical shape and is immersed in water over at least its lower half. A tube base 22 communicating with the bottom of said shelter casing is in connection with the extensible air introducing duct 23 with the top of duct 23 lying approximately flush with the top of the motor 10.

The partition tray 21 having a diameter slightly smaller than the shelter casing 20 is disposed at the bottom of the casing, defining an air collection chamber 211. The partition tray 21 has a central hole in alignment with a hole at the bottom of the casing 20 so as to permit the shaft 31 of the blade assembly 30 to pass therethrough.

The shaft 31 of the blade assembly 30 having a diameter larger than that of the output shaft 11 of the motor 10 is hollow in structure and is axially coupled to the output shaft 11 at one end and sticks out of the bottom of the casing 20 at the other end. The blades of the blade assembly 30 has four crossly arranged blades integrally mounted onto a sleeve 301. There are a plurality of slantly drilled holes 311 on the hollow shaft 31.

Adjacent to each blade of the blade assembly 30 and on the sleeve 301 are disposed at least a line of discharge bores 312 communicating with the hollow shaft 31 so as to permit air and water in the hollow shaft 31 to be discharged out thereof.

Slantly drilled holes 311 on the hollow shaft 31 are responsible for effectively introducing air into the interior of the hollow shaft 31 when the shaft 31 is rotated at high speed. The air is discharged out of the multiple bores 312 into the underwater area so as to increase the oxygen content level thereof. Water that has previously entered casing 20 through hollow shaft 31 when motor 70 is off is initially exhausted through holes 311, hollow shaft 31 and discharge openings 312. Thereafter, air is drawn down conduit 23 and out through hollow shaft 31 during the aeration operation. The length of the extensible air introducing duct 23 can be varied by a proper choice of the duct 23 in practical use.

Figure 3:
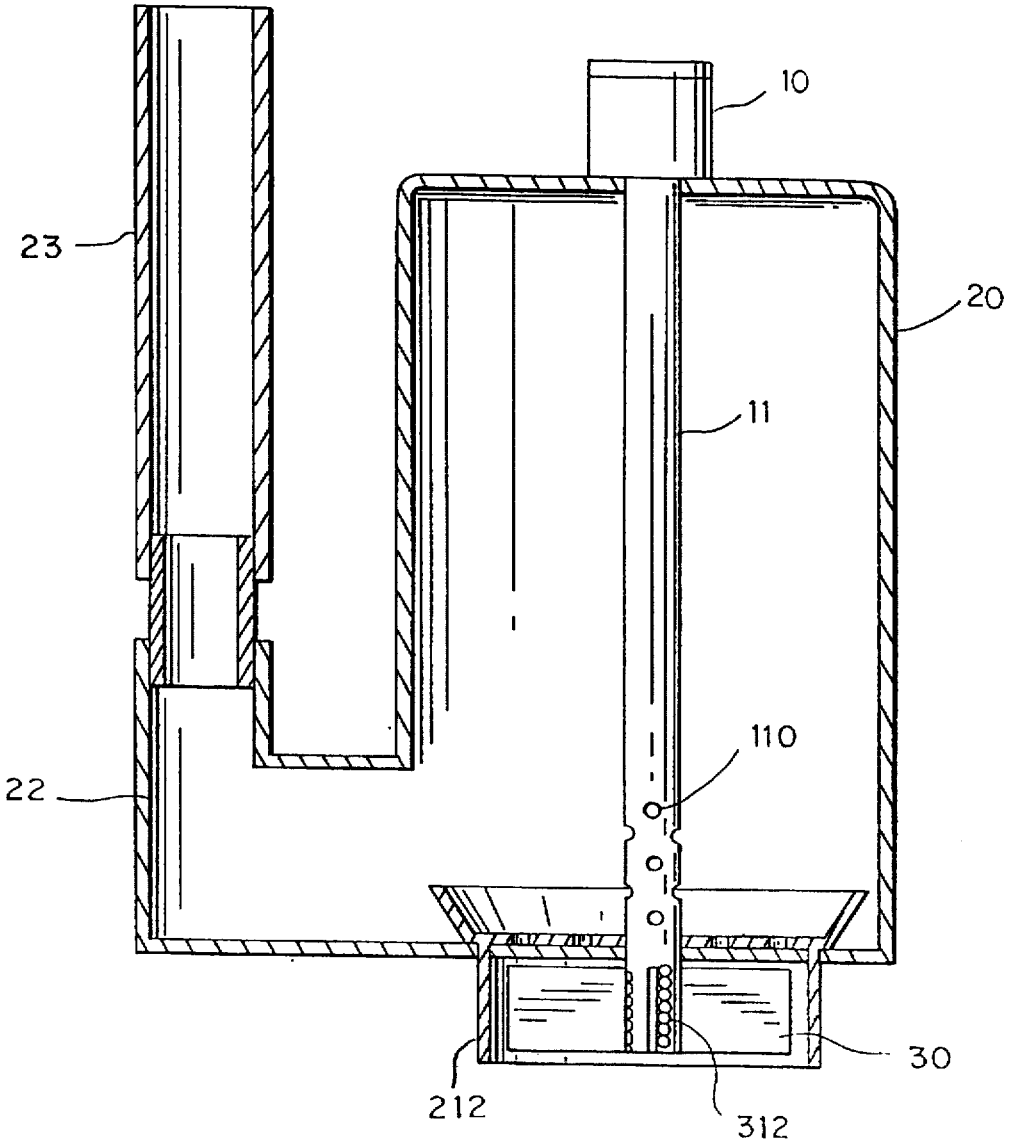
FIG. 3 is a diagram showing another embodiment of the present invention.

A second embodiment of the present invention is illustrated in FIG. 3. Basically the structure of the second embodiment is the same as the first embodiment as cited preceedingly, but the output shaft of the motor 11 of the motor 10 is directly connected to the blade assembly 30 in the second case and the lower portion of the output shaft 11 is hollow in structure with a plurality of slantly drilled holes 110 defined thereon and directly the blades of the blade assembly 30 are integrally attached to the output shaft 11, and a plurality of discharge bores 312 are disposed at the bottom end of the shaft 11 so that air and water in mixture can be led to the blade assembly 30 in the same manner and are distributed to the underwater area, increasing the oxygen content level thereof.

Moreover, the partition tray 21 has an additional downwardly extended skirt 212 which projects from the bottom of the shelter casing 20 externally so as to confine the blade assembly therein. The blade assembly in the second embodiment can be any conventional blades so as to make the production cost of the present invention as low as possible.

I claim:

1. An improved air delivering device for use in a marine farm or a fish raising pond, comprising:

a motor, a shelter casing, an air introducing pipe, blade assembly;

said motor secured to the roof of said shelter casing having an output shaft in connection to said blade assembly;

said air introducing pipe being in communication with said shelter casing;

said blade assembly having a hollow shaft with a plurality of slantly drilled holes disposed thereon being coupled to said output shaft of said motor end to end;

a partition tray disposed at the bottom of said shelter casing for defining a chamber with said shelter casing having a central hole for the passage of said hollow shaft which is further led through a hole at the bottom of said shelter casing;

said hollow shaft having a sleeve attached to the bottom thereof on which blades are integrally formed and a line of bores disposed adjacent to each said blade being disposed on said sleeve and communicating with said interior of said hollow shaft; said hollow shaft being partly housed inside said shelter casing and the bottom end engaged with said sleeve and blades being disposed externally of said shelter casing;

whereby when said motor rotates, air introduced in said chamber defined by said partition tray and the shelter casing and water will be taken into said hollow shaft via said slantly drilled holes and further discharged via said multiple bores on said sleeve so as to increase underwater oxygen content level of a fish-raising pond.

2. The improved air delivering device as claimed in claim 1 wherein said shelter casing has a base tube extending therefrom so as to permit an extensible air introducing duct to be connected thereto for varying the length thereof easily.

3. The improved air delivering device as claimed in claim 1 wherein said shelter casing has a base tube extending therefrom so as to permit an extensible air introducing duct to be connected thereto for varying the length thereof easily.

4. An improved air delivering device for use in a marine farm or a fish raising pond, comprising:

a motor, a shelter casing, an air introducing pipe, blade assembly;

said shelter casing in cylindrical shape having a through hole at the bottom thereof;

said motor secured top the roof of said shelter casing having an enlongated output shaft connected to said blade assembly, said output shaft being provided with a hollow portion at the bottom end thereof on which a plurality of slantly drilled holes and a plurality of discharge bores are disposed;

said bottom end of said output shaft being secured to a number of blades comprising the blade assembly with a line of said discharge bores disposed adjacent to each of said blades;

said air introducing pipe being in communication with said shelter casing;

a partition tray for defining a chamber with said shelter casing disposed at the bottom of said shelter casing having a central hole for the passage of said output shaft which is further led through a hole at the bottom of said shelter casing;

said partition tray having a downwardly extended flanged skirt disposed outside of said shelter casing for confining said blade assembly and said output shaft of said motor;

whereby when said motor rotates, air introduced in said chamber defined by said partition tray and the shelter casing and water will be taken into said partially hollow output shaft through said slantly drilled holes and discharged through said multiple bores on said output shaft so as to increase underwater oxygen content level of a fish-raising pond.

* * * * *